US008389450B2

(12) United States Patent
Theyssen et al.

(10) Patent No.: US 8,389,450 B2
(45) **Date of Patent: *Mar. 5, 2013**

(54) LUBRICANT CONCENTRATE CONTAINING A PHOSPHATE TRIESTER

(75) Inventors: Holger Theyssen, Freinsheim (DE); Mario Stanga, Bassano (IT); Franco Bruschi, Codogno (IT); Stefan Wiemer, Riedstadt (DE)

(73) Assignee: Diversey, Inc., Sturtevant, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/239,543

(22) Filed: Sep. 22, 2011

(65) Prior Publication Data

US 2012/0006652 A1 Jan. 12, 2012

Related U.S. Application Data

(63) Continuation of application No. 11/815,949, filed as application No. PCT/US2006/003728 on Feb. 2, 2006, now Pat. No. 8,119,580.

(30) Foreign Application Priority Data

Feb. 11, 2005 (EP) ..... 05002950

(51) Int. Cl.
*C10M 137/04* (2006.01)
*C10M 133/02* (2006.01)
*C10M 129/26* (2006.01)

(52) U.S. Cl. ..... 508/431; 508/556; 508/539

(58) Field of Classification Search ..... 508/431, 508/556, 539

See application file for complete search history.

(56) References Cited

U.S. PATENT DOCUMENTS

| | | | | |
|---|---|---|---|---|
| 5,049,292 | A | 9/1991 | Grasshoff et al. | |
| 5,062,979 | A | 11/1991 | Scharf et al. | |
| 5,723,418 | A * | 3/1998 | Person Hei et al. | 508/511 |
| 5,935,914 | A | 8/1999 | Theyssen et al. | |
| 6,756,347 | B1 | 6/2004 | Besse et al. | |
| 8,119,580 | B2 * | 2/2012 | Theyssen et al. | 508/431 |
| 2003/0158049 | A1 | 8/2003 | Prince et al. | |
| 2006/0252659 | A1 | 11/2006 | Kinoshita et al. | |

FOREIGN PATENT DOCUMENTS

| | | |
|---|---|---|
| CN | 1398293 | 2/2003 |
| JP | H02115296 | 9/1990 |
| JP | 6330079 | 11/1994 |
| JP | H08507096 | 7/1996 |
| JP | H10511140 | 10/1998 |
| JP | 2001502371 | 2/2001 |
| JP | 2001064666 | 3/2001 |
| WO | 98/16603 | 4/1998 |
| WO | 00/22073 | 4/2000 |
| WO | 01/18160 | 3/2001 |
| WO | 2004/096959 | 11/2004 |

* cited by examiner

*Primary Examiner* — Jim Goloboy

(74) *Attorney, Agent, or Firm* — Gregory S. Bollis

(57) ABSTRACT

The present invention relates to a lubricant concentrate containing the following components (i) at least one amine, (ii) at least one phosphate according to the general formula (I),

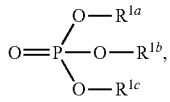

(I)

(iii) at least one acid, (iv) optionally at least one ether carboxylic acid compounds with the general formula (II)

$$R^{20}—(O(CH_2)_m)_nOCH_2COO^-M^+ \quad (II),$$

(v) optionally at least one further aid or additive.

21 Claims, No Drawings

LUBRICANT CONCENTRATE CONTAINING A PHOSPHATE TRIESTER

CROSS-REFERENCES TO RELATED APPLICATIONS

This application is a Continuation of U.S. patent application Ser. No. 11/815,949, filed on Nov. 4, 2008, which is a 371 U.S. National Phase Filing of PCT/US2006/003728, filed on Feb. 2, 2006, which claims priority to European Patent Application No. 05002950.3, filed on Feb. 11, 2005.

The present invention relates to a lubricant concentrate, of which the diluted use solution is suitable for lubricating and cleaning of conveyor belt installations in the food industry, particularly by means of immersion or automatic belt lubricating systems.

The invention further relates to a process for the production of the lubricant concentrate or the aqueous use solution of the lubricant concentrate as well as the use of the lubricant concentrate and the aqueous use solution for lubricating and cleaning of conveyor belt installations, in particular by means of immersion lubricating or automatic belt lubricating installations, particularly in the food industry. The use thereby particularly relates to filling foods, especially with beverages, of glass and plastic bottles, particularly in this case polyethylene terephthalate (PET), polyethylene naphthalate (PEN) or polycarbonate (PC), boxes, metal cans, glasses, vessels, refillable cans, barrels or vessels, such as KEGs, beverage containers, paper and cardboard holders and the like.

In food industry the conveyance of beverage packings made of metal, glass, paper, cardboard and/or plastic using a lubricant concentrate, respectively its aqueous use solution, is commonly applied.

Presently beverages are being sold in several different containers. Thus, beverages are offered in glass bottles, plastic bottles, plastic containers, metal cans, boxes, wax cartons, etc. In the filling plants these containers have to be transported during filling to several stations. Generally this occurs by means of feed or conveyance belt installations (having chains or tracks), which usually consist of stainless steel or plastic, insofar as these containers concern glass containers, or the conveyance belt installations consist of plastic materials like polypropylene or certain polyacetates, insofar as these containers concern other than glass bottles or glass containers. Following hereafter, such installations are referred to as feed and conveyance installations or as conveyor belt installations.

During filling and transport of the mentioned containers sometimes a turning over or a blocking of the containers may occur, while the conveyor belts are running further without hindrance. Especially in this case a sufficient lubrication of the conveyor belts is required in order that the belt can move forward without hindrance even when the containers on the belt cannot move forward during some time.

For this purpose it is required, as already mentioned before, to lubricate and to clean the parts of the feed and conveyance installations, which come into contact with the beverage containers, sufficiently. If the conveyance installations are not lubricated sufficiently this can, on the one hand, lead to the falling down of the containers, or on the other hand, have the result that they do not stop, although the respective filing up, cleaning or labelling station has already been reached. Both kind of malfunctions can lead to longer down time of the conveyance installations and to considerable loss of capacity.

Presently, there are several different types of lubricant concentrates known, which can in principal be divided into 4 main groups: i) lubricants on the basis of soap, ii) lubricants on the basis of polysiloxanes (such as those described in WO 01/18160), iii) lubricants on the basis of fatty amines (such as those described in WO 98/16603) and iv) lubricants on the basis of phosphate esters. Additionally, the pH-value of the lubricant compositions (both the concentrate and the diluted aqueous use solution) may differ, since many of the known compositions have a pH-value in the range between 5 and 8, but there are also lubricant compositions known having a pH-value between 7 and 11. Lubricant compositions having a pH-value within the acid up to the neutral range have the advantage that there is less stress cracking observed when employing plastic material, such as polyethylene terephthalate (PET) bottles. For each lubricants concentrate the individual components have to be harmonized to provide stable compositions for the pH-range intented to be applied.

Some of the lubricants based on phosphate esters also include an amine compound. U.S. Pat. No. 6,756,347 B1 discloses lubricant compositions comprising at least one alkyl alkoxylated phosphate ester, one aryl alkoxylated phosphate ester, one aromatic or linear quaternary ammonium antimicrobial agent and a liquid carrier, such as water. The phosphate components are in both cases (alkyl alkoxylated or aryl alkoxylated) either a phosphate monoester or a phosphate diester. The pH-value of said compositions is in the range between 6 and 8.5.

Another lubricant on the basis of phosphate esters is disclosed in WO 00/22073. That lubricant comprises a phosphate monoester with the ester component on the basis of polyethylene oxide, which is additionally substituted with an amide. A disadvantage of said lubricant composition is that the synthesis of the phosphate ester component is rather complex including educts such as phosphorous pentoxide, therefore, the production of the lubricant concentrate is rather cost-intensive.

Another lubricant composition based on phosphate esters is disclosed in JP-B 6330079 comprising an alkyl amine and an alkyl(poly)alkoxylated phosphate monoester or a mixture of the phosphate monoester and the respective phosphate diester. Said compositions are employed at a pH-value between 5 and 8.

The object of the present invention is the provision of a new and stable lubricant concentrate on basis of phosphate esters, which can be easily produced at low costs. Furthermore, the new lubricant concentrate should have at least a comparable or, in preferred embodiments, an enhanced lubricity causing reduced friction compared to the known lubricants based on phosphate esters. It is also an object of the invention to provide a lubricant concentrate causing fast formation of the lubricant film on the conveyor belt installations (tracks or chains). Furthermore, it is also an object of the present invention that the lubricant film can be very uniformly applied to the conveyor belt installations.

The object is achieved by a lubricant concentrate containing the following components (i) at least one amine;

(ii) at least one phosphate according to the general formula (I),

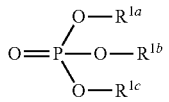

(I)

wherein $R^{1a}$, $R^{1b}$ and $R^{1c}$ independently from each other are the same or different and indicate $C_1$-$C_{30}$-alkyl or —([$CH_2$]$_m$—O)$_n$—$R^{1d}$, where m is 2 or 3, n is 1 to 10 and $R^{1d}$ is $C_1$-$C_{30}$-alkyl, phenyl or phenyl-($C_1$-$C_{10}$-alkyl)-;

(iii) at least one acid (iv) optionally at least one ether carboxylic acid compound with the general formula (II)

$$R^{20}—(O(CH_2)_m)_nOCH_2COO^-M^+ \quad (II)$$

wherein $R^{20}$ is a saturated, linear or branched alkyl rest with 1 to 22 carbon atoms or a mono or polyunsaturated linear or branched alkenyl or alkynyl rest with 2 to 22 carbon atoms or an aryl rest optionally substituted with at least one $C_1$-$C_{22}$ alkyl, $C_2$-$C_{22}$ alkenyl or $C_2$-$C_{22}$-alkynyl, n is a positive number between 0 and 30, and m is 2 or 3, M is hydrogen or an alkali metal;

(v) optionally at least one further aid or additive;

whereby the portion of the components (i) (ii) (iii) with respect to the concentrate is 1 to 100 wt. %, and said optional components (iv) and (v) may be present in portions up to 99 wt. %, whereby the portions (i)-(v) are chosen such that the total results in 100 wt. %.

The advantage of the lubricant concentrate of the present invention is that it can be easily produced at low cost and enhanced lubricity is provided compared to those lubricant compositions based on phosphate esters known from the state of the art. Enhanced lubricity causes reduced friction on the conveyor belt installations (being determined by the friction coefficient μ) and therefore improved conveyance of the employed beverage packings regardless of their material of the packings or the conveyor's chains.

A further advantage is that the lubricating film is formed faster on the conveyor belt installations (tracks or chains). This implies that an improved number of beverage packings (improved capacity) can be handled on the conveyor belt installations, since these systems can only be operated having a sufficient amount of lubricant on the tracks or chains forming a preferably uniform lubricating film. In case there is no sufficient and/or uniform lubrication provided on the tracks or chains of the lubricant belt installations, beverage packings such as bottles cause either a blocking of the whole system or they may even be destroyed by falling from the tracks or chains.

A further advantage of the lubricant concentrate of the present invention is that the lubricating film is formed more uniformly and for a longer period of time on the conveyer belt installations. Due to the more uniformly formation of the lubricating film on the tracks or chains the beverage packings can be transported more smoothly. This also implies that a fewer amount of lubricant concentrate is required to provide a uniform lubricating film, which is attained for a longer period of time. As a further consequence, less solvent, which is used for diluting the lubricant concentrate, in particular water, is consumed causing additional cost reduction.

The lubricant concentrate of the present invention can be employed for all types of conveyor belt systems (such as plastic chains or stainless steel chains) and all types of beverage packing materials (such as glass or plastic containers). In contrast to many of the known lubricant concentrates, the lubricant concentrate of the present invention has a significant stability at a pH-range between 3 and 9, since it can be stored as a single phase system (in form of a clear solution) over several weeks. Preferred lubricant compositions, containing as a further (optional) component at least one ether carboxylic acid according to the below indicated general formula II, have the advantage that besides a further improvement in terms of lubricity also improved water compatibility can be observed in comparison to those lubricant concentrates of the present invention without these optional component. Lubricant concentrates additionally containing an ether carboxylic acid are good sulphate controllers having an excellent hard water tolerance.

The Component (i):

The lubricant concentrate according to the invention contains as component (i) essentially one or more amines. The term "amine", as used in the context of the invention, includes thereby in a broader context monoamine, polyamine, cyclic amidine as well as its hydrolysis products or noncyclic synthesis pre-steps, oxalkylated amine, amine additionally containing an amido-group and salts of the previously mentioned compounds.

It has to be indicated that due to the presence of further components containing cations, for example protons, such as the acids of component (iii), the employed amines may be partially or completely transferred into the corresponding salts during the preparation and/or storage of the lubricant concentrate. This is particularly relevant if the lubricant concentrate contains a solvent, such as water, or in the corresponding aqueous use solution of the lubricant concentrate. The following compounds of components (i), (ii), (iii), (iv) and (v) are listed with their chemical structure/name before mixing the individual components with each other to prepare the lubricant concentrate. Nevertheless, the amine (component (i)) may already be employed in its salt form as starting material when producing the lubricant concentrate of the present invention.

The monoamines which can be applied according to the invention include, among others, primary, secondary, tertiary and quaternary amines according to the general formulas III-V and Va,

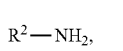

(III)

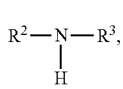

(IV)

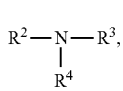

(V)

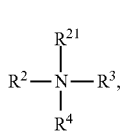

(Va)

wherein $R^2$, $R^3$, $R^4$ and $R^{21}$ independently from each other are the same or different and indicate $C_2$-$C_{30}$-alkyl, $C_5$-$C_{30}$-aryl, $C_2$-$C_{30}$-alkenyl, $C_2$-$C_{30}$-alkynyl, $C_3$-$C_{30}$-cycloalkyl, $C_6$-$C_{30}$-arylalkyl or heteroaryl with 5 to 7 ring atoms, whereby the mentioned rest may be further substituted by one or more amine, imine, hydroxyl, halogen and/or carboxyl rests as well as salts of the compounds with the formula III-V. Two of the rests $R^2$ to $R^4$ could also be closed to form a ring, so that cyclic amines, like e.g. pyridine, chinoline, isochinoline, piperazine, morpholine, etc., as well as its C-alkyl derivatives.

Preferred monoamine compounds are those according to the general formula IV and V, as well as salts of these compounds, which correspond to the general formulas VI and VII, (VI)

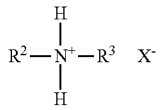

(VII)

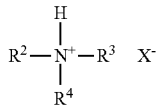

wherein $R^2$, $R^3$ and $R^4$ independently from each other are the same or different and indicate:

a substituted or unsubstituted, linear or branched, saturated or mono or polyunsaturated alkyl rest with 6 to 22 C-atoms, which as substituents can display at least one amine, imine, hydroxyl, halogen and/or carboxyl rest, a substituted or unsubstituted phenyl rest, which as substituents can display at least one amine, imine, hydroxyl, halogen, carboxyl and/or a linear or branched, saturated or mono or polyunsaturated alkyl rest with 6 to 22 C-atoms, and as the anion $X^-$ all the customary rests, which are familiar to the professional, which originate from inorganic acids and/or organic acids and which do not influence the lubricant concentrate according to the invention in a detrimental manner, for example do not result in undesired turbidity or standstills, can be applied.

In the sense of the present invention such acids are preferred of which the anion $X^-$ is chosen from the group: amidosulphonate, nitrate, halide, hydrogensulphate, sulphate, hydrogencarbonate, carbonate, phosphate or $R^5$—$COO^-$ whereby the rest $R^5$ indicates hydrogen, a substituted or unsubstituted, linear or branched alkyl rest with 1 to 20 C-atoms, whereby the substituents are chosen from one or more hydroxyl, amine, imine and/or carboxyl rests. Especially mentioned as examples for the organic anions $X^-$ of the type $R^5$—$COO^-$ are: formate, acetate, glycolate, oleate, lactate, gluconate, citrate and glutamate.

More preferred monoamines or salts of it correspond to the general formulas IV, V, VI and VII, wherein $R^2$ is a saturated or unsaturated, branched or linear alkyl group with 8 to 22 carbon atoms, $R^3$ indicates $A^1$-COOH, wherein $A^1$ indicates a linear or branched alkenyl group with 2 to 4 carbon atoms and $R^4$ indicates an alkyl group or hydroxyl-alkyl group with 1 to 4 carbon atoms. Polyamines which also could be applied according to the invention as components (i) are those corresponding to the general formula VIII, as well as salts thereof, (VIII)

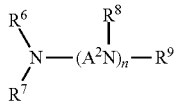

wherein $R^6$, $R^7$, $R^8$ and $R^9$ independently from each other are the same or different and indicate:

hydrogen, a substituted or unsubstituted, linear or branched alkyl rest with 1 to 22 C-atoms or a mono or polyunsaturated alkenyl rest with 2 to 22 C-atoms, which could display as substituents one or more hydroxyl, amine, imine, halogen and/or carboxyl rests or a substituted or unsubstituted phenyl rest, which could display as substituents one or more amine, imine, hydroxyl, halogen, carboxyl and/or possibly again substituted, linear or branched, saturated or mono or polyunsaturated alkyl rest with 1 to 22 C-atoms, $A^2$ indicates a linear or branched alkylene group with 1 to 8 carbon atoms, and n is a positive integer number in the range of 1 to 30.

Preferred polyamines are of the general formula VIII, wherein $R^7$, $R^8$ and $R^9$=hydrogen $A^2$=—$(CH_2)_3$—, and n=1 or 2

Also the salts of those compounds which belong to the following general formulas (IX) and (X) can be preferably applied, $$R^6\text{—NH—}(CH_2)_3N^+H_3X^- \quad \text{(IX)}$$

$$R^6\text{—}^+NH_2\text{—}(CH)_{2\ 3}N^+H_3 2X^- \quad \text{(X)},$$

wherein $R^6$ has the meaning as mentioned for the formula VIII and $X^-$ the meaning as mentioned for the formulas VI and VII.

In another embodiment of the present invention, preferred polyamines can also be obtained according to the general formula VIII, wherein $R^6$ is a saturated or unsaturated, branched or linear alkyl group with 8 to 22 carbon atoms, $R^7$ is hydrogen, an alkyl group of hydroxyl-alkyl group with 1 to 4 carbon atoms or $A^2$-$NH_2$, n=1 and $R^8$ and $R^9$ indicate hydrogen.

Some individual examples of polyamines which could preferably be applied according to the invention are (among others) ethylene diamine, diethylene triamine, triethylene tetra-amine, propylene diamine, dipropylene triamine, tripropylene tetra-amine, butylene diamine, aminoethyl propylene diamine, aminoethyl butylene diamine, tetramethylene diamine, hexamethylene diamine, N-coco-1,3-diaminopropane(N-cocos fatty-alkyl-1,3-diaminopropane), N-tallow-1,3-diaminopropane(N-tallow fatty-alkyl-1,3-diaminopropane), N-oleyl-1,3-diaminopropane, N-lauryl-1,3-diaminopropane, each time in the form of the free amine or in the form of the salt like formate, acetate, oleate, glycolate, lactate, gluconate, citrate, glutamate, benzoate or salicylate.

More preferred polyamines are N-tallow-1,3-diaminopropane, N-coco-1,3-diaminopropane and N-oleyl-1,3-diaminopropane, the most preferred polyamine is N-oleyl-1,3-diaminopropane.

Next to it also polyamine derivatives of a fatty amine according to the general formula XI can be applied as component (i) of the lubricant concentrate according to the invention, $$R^2\text{-}A^3\text{-}(CH_2)k\text{-NH—}[(CH_2)l\text{-NH}]y\text{-}(CH_2)_m\text{—}NH_2\cdot(H^+X^-)_n \quad \text{(XI)},$$

whereby $R^2$ and $X^-$ have the meaning as indicated for the formulas VI and VII, $A^3$ either indicates —NH— or —O—, k, l, m independently from each other are the same or a different number in the range of 1 to 6, y indicates 0, 1, 2 or 3 in case $A^3$=—NH— and 1, 2, 3 or 4 in case $A^3$=—O— and n is an integer in the range of 0 to 6.

In the above mentioned general formula (XI) the following rest groups can be applied as substituents $R^2$: n-hexyl, n-heptyl, n-octyl, n-nonyl, n-decyl, n-undecyl, n-dodecyl, n-tridecyl, n-tetradecyl, n-pentadecyl, n-hexadecyl, n-heptadecyl, n-octadecyl, n-nonadecyl, n-eicosyl, n-uneicosyl and n-docosyl as well as the branched-chain isomers of the mentioned alkyl rests. Instead of the saturated alkyl rest $R^2$ can also indicate the corresponding—mono or poly-unsaturated alkyl rest, which can also be linear or branched. The above indicated rests can also be substituted, whereby as substituents one or more amine, imine, hydroxyl, halogen or carboxyl group can be used. Moreover, the rest $R^2$ also can indicate a phenyl rest, which can also be substituted with one or more amine, imine, hydroxyl, halogen or carboxyl group. Also alkylphenyl rests can be used for $R^2$ whereby the alkyl rest contains 6 to 22 C-atoms and which can also be linear or branched, saturated or mono or polyunsaturated. In all cases chlorine and bromine are preferred as halogen substituents.

Preferred are polyamines according to the general formula XI, whereby $A^3$=—NH—, k, l and m are independently from each other 3 or 4, y is 0 or 1 and the other variables have the meanings as are indicated before for the formula (XI).

More preferred thereby are all the amines of formula XI, wherein k, l and m is 3.

Polyamines which correspond to the previously indicated general formula XI can be prepared according to processes as are known from literature and further are also offered to some extend as commercial products by the company Berol Nobel, Stockholm, Sweden, under the denomination Amine 640, Amine 660, Amine 740, Amine 760 and Amine 780.

According to another implementation of the present invention, polyamine derivatives of fatty amines of the previously mentioned general formula (XI) are preferred, whereby $R^2$ indicates a linear or branched, saturated or mono or polyunsaturated alkyl rest with 12 to 18 C-atoms, $A^3$ indicates —NH— and $X^-$ indicates the rest $R^5$—$COO^-$, whereby $R^5$ indicates hydrogen, $CH_3$—, HO—$CH_2$— or $CH_3$—CH(OH)—.

Also applicable as components (I) according to the invention are cyclic amidines for example imidazoline or tetrahydropyrimidine, etc. according to the general formula XII or salts thereof (XII)

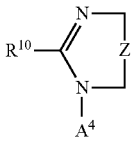

wherein

Z is an alkylene group with 1 to 6 C-atoms, $A^4$ is hydrogen or $(A^5NH)_n$—H, $A^5$ is an alkylene group with 1 to 18 C-atoms, which possibly can be mono or polyunsaturated, and $R^{10}$ is an alkyl, aryl, arylalkyl, cycloalkyl or hetero-ring with—where possible and useful, respectively—between 1 and 30 C-atoms.

Preferred as cyclic amidines are compounds corresponding to the general formula (XIII), (XIII)

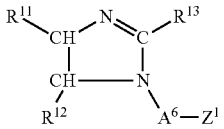

wherein, $R^{11}$, $R^{12}$, $R^{13}$ are the same or different hydrogen or $A^7$-$Z^2$ $A^6$ is a saturated or unsaturated, linear or branched alkylene rest with 1 to 20 carbon atoms, $A^7$ is a saturated or unsaturated, linear or branched alkylene rest with 7 to 20 carbon atoms, $Z^3$ is hydrogen, $NH_2$, OH or $COOM^1$, $M^1$ is hydrogen or an alkali metal, $Z^1$ is hydrogen, $NH_2$, OH, $COOM^2$ or —NH—CO—$R^{14}$, $M^2$ is the same or different from $M^1$ hydrogen or an alkali metal, and $R^{14}$ is a saturated or unsaturated, linear or branched alkyl group, respectively alkenyl group, with 6 to 20 carbon atoms.

With regard to the compounds according to the general formula XIII preferably at least one of the rests $R^{11}$, $R^{12}$, $R^{13}$, $A^6$ and/or $R^{14}$ contains a saturated or unsaturated alkylene group with at least 12 C-atoms or a branched alkylene group with at least 12 carbon atoms.

Further, within the group of compounds according to the general formula XIII, those compounds where $A^7$ contains 12 to 18 carbon atoms are particularly useful, it is particularly preferred if $A^7$ corresponds to a $C_{17}$ rest group. A6 preferably has 1 to 6 carbon atoms, very favourable is a —$CH_2$—$CH_2$— group. A very advantageous variant of $Z^1$ is $NH_2$. Even more favourable properties have compounds according to the general formula XIII, or as constituent of the component (i), wherein $Z^1$ is $NH_2$, $R^{11}$ and $R^{12}$ is hydrogen, $R^{13}$ is $A^7Z^2$, $A^7C_{17}$ and $Z^2$ is hydrogen.

Preferred cyclic amidines also include salts of compounds with the general formula XIII, which correspond to the general formula XIV:

(XIV)

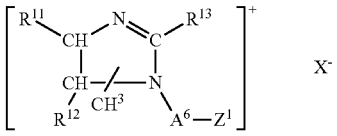

wherein the rests $R^{11}$, $R^{12}$, $R^{13}$, $A^6$ and $Z^1$ can take the meaning as shown by formula XIII, the $CH_3$-ring substituent is bound in the 1 or 3-position of the imidazoline ring and $X^-$ is a suitable anion, as for example is indicated in connection with the explanation of $X^-$ in formula XI. It is particularly preferred if $X^-$ is $CH_3$—O—$SO_3$—.

In addition to the cyclic compounds of the formulas XIII and XIV also linear amides with the general formula XV and XVI are suitable as component (i)

(XV)

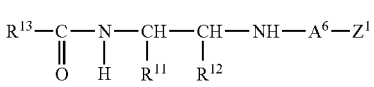

-continued (XVI)

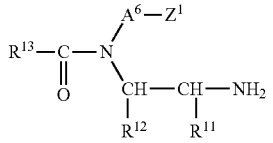

wherein the rests $R^{11}$, $R^{12}$, $R^{13}$, $A^6$ and $Z^1$ have the meaning as is indicated for the formulas XIII or XIV.

The compounds according to the formulas XV and XVI can also become available as by-products during the synthesis of the compounds XIII or XIV, they can also develop during the storage of these compounds, for example by hydrolysis, or also formed by means of direct synthesis without a detour via a cyclic intermediate product.

Oxalkylated amines, e.g. oxalkylated derivatives of the above mentioned amine (monoamine, polyamine, cyclic amidine etc.) are also suitable, within the scope of the invention, as component (i). The oxalkylated derivatives thereby show the group $—(OA^8)_n$-, which can be derived from any suitable α,β-alkyleneoxide with the general formula XVII, (XVII)

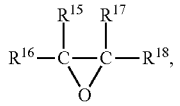

wherein $R^{15}$, $R^{16}$, $R^{17}$ and $R^{18}$ independently from each other are the same or different, hydrogen or a possibly substituted rest, like e.g. alkyl, cycloalkyl, aryl, etc.

Examples include among others ethyleneoxide, propyleneoxide, butyleneoxide, amyleneoxide, octyleneoxide, styroloxide, methylstyroloxide, cyclohexaneoxide (wherein $R^{15}$ and $R^{17}$ are forming a ring together), etc.; instead of alkyleneoxide also alkylenecarbonate, e.g. ethylenecarbonate, propylenecarbonate, etc., can be applied.

$—(OA^8)_n$- means homo units like $—(OEt)_n$-, $—(OPr)_n$-, $—(OBu)_n$-, $—(O\text{octyl})_n$-, etc.;

block units like $—(OEt)_a(OPr)_b$-, $—(OEt)_a(OBu)_{b-r}(OPr)_a(OEt)_b(OPr)_c$, $—(OEt)_a(OPr)_b(OBu)_c$, etc., wherein a+b+c=n;

groups containing hetero units, which contain a coincidental statistical sequence of more than one oxide $(OEt\text{-}OPr)_n$, $(OPr—OBu)_n$, $(OEt\text{-}OBu)_n$, whereby the proportion of one oxide to the other is e.g. 1-99 to 99-1;

hetero-homo units like e.g.

$(EtO)_a(EtO—PrO)_b$ $(EtO)_a(PrO)_b(EtO\text{-}rO)_c$, $(EtO—PrO)_a(BuO)_b$, etc.

Preferred oxalkylated amines are compounds according to the general formulas XVIII and XIX:

(XVIII)

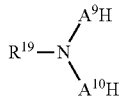

-continued (XIX)

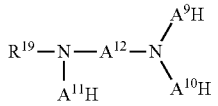

wherein $R^{19}$ is a linear or branched, saturated or unsaturated, alkylene rest with 8 to 22 carbon atoms, $A^{12}$ is a linear or branched alkylene group with 8 to 22 carbon atoms, $A^9$, $A^{10}$, $A^{11}$ are the same or different and each indicates at least one ethoxy or propoxy group or a bonding, whereby the total of the groups $A^9$, $A^{10}$, $A^{11}$ is between 2 and 200.

Useful compounds among others are:

Cocos-bis(2-hydroxylethyl)amine, polyoxyethylene(5)cocos-amine, polyoxyethylene(15)cocos-amine, tallow-bis(2-hydroxylethyl)amine, polyoxyethylene(5)tallow-amine, tallow/oleyl-bis(2-hydroxylethyl)amine, oleyl-bis(2-hydroxylethyl)amine, polyoxyethylene(5)oleylamine, polyethylene(15)oleylamine, tallow-bis(2-hydroxylethyl)amine (hydrated), polyoxyethylene(5)tallow-amine (hydrated), polyoxyethylene(15)tallow-amine (hydrated), polyoxyethylene(50)tallow-amine, N,N',N'-tris(2-hydroxylethyl)N-tallow-1,3-diaminopropane, N,N',N'-polyoxyethylene (10)-N-tallow-1,3-diamino-propane, N,N',N'-polyoxyethylene(15)-N-tallow-1,3-diaminopropane and poly oxyethylene(15)-tallow-amine.

The lubricant concentrate according to the invention preferably contains as component (i) one or more polyamines according to the general formula VIII, or a salt thereof. More preferably it contains as component (i) one or more polyamines according to the general formula VIII, wherein $R^7$, $R^8$ and $R^9$ are hydrogen, $A^2$ is $—(CH_2)_3—$ and n is 1 or 2. It contains as component (i) much more preferably N-tallow-1,3-diaminopropane, N-coco-1,3-diaminopropane and/or N-oleyl-1,3-diaminopropane, most preferably N-oleyl-1,3-diaminopropane.

The Component (ii):

The lubricant concentrate according to the invention contains as component (ii) essentially one or more phosphates according to the general formula I, (I)

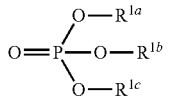

wherein $R^{1a}$, $R^{1b}$ and $R^{1c}$ independently from each other are the same or different and indicate $C_1$-$C_{30}$-alkyl or $—([CH_2]_m—O)_n—R^{1d}$, where m is 2 or 3, n is 1 to 10 and $R^{1d}$ is $C_1$-$C_{30}$-alkyl, phenyl or phenyl-($C_1$-$C_{10}$-alkyl)-. As indicated below the alkyl and/or phenyl fragments of $R^{1a}$ to $R^{1d}$ may optionally be further substituted. Compounds according to formula (I) can be assigned as phosphate triesters.

Preferred phosphates according to general formula I are those, wherein $R^{1a}$, $R^{1b}$ and $R^{1c}$ independently from each other are the same or different and indicate $—([CH_2]_m—O)_n—R^{1d}$, where m is 2, n is 1 to 3 and $R^{1d}$ is $C_1$-$C_{30}$-alkyl. More preferred are compounds according to the general formula I, wherein $R^{1a}$, $R^{1b}$ and $R^{1c}$ have the same meaning and indicate $—([CH_2]_m—O)_n—R^{1d}$, where m is 2, n is 1 to 3 and $R^{1d}$ is $C_1$-$C_{30}$-alkyl. Even more preferred are compounds of the general formula I, wherein $R^{1a}$, $R^{1b}$ and $R^{1c}$ have the same meaning and indicate —$CH_2$—$CH_2$—O—($C_1$-$C_{10}$-alkyl). Most preferred are compounds according to the general formula I, wherein $R^{1a}$, $R^{1b}$ and $R^{1c}$ are each butoxyethyl.

Compounds according to general formula (I) are be commercially available, such as tris(2-butoxyethyl)phosphate (trade name: Etingal IP®, BASF AG), or they can be synthesized according to methods known by a skilled person.

The Component (iii):

The lubricant concentrate according to the invention contains as a further essential component one or more acids. All suitable inorganic or organic acids can be employed. Examples of inorganic acids are hydrochlorid acid, hydrobromic acid, phosphoric acid, metaphosphoric acid, nitric acid, sulfonic acid and sulphuric acid. Examples for organic acids are formic acid, acetic acid, propionic acid, butyric acid, stearic acid, oxalic acid, melonic acid, succinic acid, glutaric acid, benzoic acid, citric acid, maleic acid, fumaric acid, methansulfonic acid, acrylic acid, propiolic acid, methacrylic acid, crotonic acid, isocrotonic acid, oleic acid, elaidic acid and trifluoroacetic acid. If existing said acids can be either employed in the pure form or diluted in a solvent, preferably in water. The employment of acids diluted in water is preferred. Preferred components (iii) are saturated aliphatic monocarboxylic acids containing from one up to eight carbon atoms ($C_1$-$C_8$-monocarboxylic acids). More preferred components (iii) are acetic acid or formic acid, whereby both acids are preferably diluted with water in a 40 to 60 wt. % concentration. The most preferred component (iii) is acetic acid, diluted with water in a 40 to 60 wt. % concentration.

The Component (iv),

The lubricant concentrate according to the invention may contain as an optional component one or more ether carboxylic acid compounds with the general formula (II)

$$R^{20}—(O(CH_2)_m)_nOCH_2COO^-M^+ \quad (II)$$

wherein $R^{20}$ is a saturated, linear or branched alkyl rest with 1 to 22 carbon atoms or a mono or polyunsaturated linear or branched alkenyl or alkynyl rest with 2 to 22 carbon atoms or an aryl rest optionally substituted with at least one $C_1$-$C_{22}$ alkyl, $C_2$-$C_{22}$ alkenyl or $C_2$-$C_{22}$-alkynyl, n is a positive number between 0 and 30, and m is 2 or 3, M is hydrogen or an alkali metal.

As ether carboxylic acids with the general formula (II), which can be applied advantageously, can be mentioned among others:

| $R^{20}$ | n | name |
|---|---|---|
| Lauryl | 2 to 5 | Laureth-4 carboxylic acid |
| Lauryl | 3 to 8 | Laureth-5 carboxylic acid |
| Lauryl | 4 to 5 | Laureth-6 carboxylic acid |
| Lauryl | 10 | Laureth-11 carboxylic |
| Lauryl | 13 | Laureth-14 carboxylic |
| Oleyl | 5 | Oleth-6 carboxylic add |
| Oleyl | 9 | Oleth-10 carboxylic acid |
| Octylphenol | 8 | Octoxynol-9 carboxylic |
| Octylphenol | 19 | Octoxynol-20 carboxylic |
| Norylphenol | 0 | Nonoxynol-carboxylic |
| Norylphenol | 7 | Nonoxynol-8 carboxylic |
| Stearyl | 6 | Steareth-7 carboxylic |
| Stearyl | 10 | Steareth-11 carboxylic |
| Cetyl/Stearyl | 6 | Ceteareth-7 carboxylic |
| Lauryl | 16 | Laureth-17 carboxylic |
| Tallow | 6 | Talloweth-7 carboxylic |

Preferred compounds according to the general formulas (II) are those whereby $R^{20}$ is a $C_3$-$C_{18}$-alkyl or alkenyl group, n is between 2 and 9 and M is hydrogen, sodium or potassium. Most preferred is when $R^{20}$ is an oleyl group and n is 9.

The ether carboxylic acids according to the general formula are available commercially or can be synthesized according to processes known from the literature. For example, the compounds mentioned in the table can be obtained under the trade name AKYPO from the company CHEM-Y as special surfactant.

The Component (v):

The component (v) is optional and therefore only possibly contained in the lubricant concentrate according to the invention. As component (v), the lubricant concentrate according to the present invention may contain one or more of the following compounds also assigned as aid or additive, which can be independently selected from each other.

As component (v) water can be applied. The added water may be soft water, hard water or softened water, preferably softened water is employed.

The lubricant concentrate according to the invention may contain as a further optional component (v) one or more polyethylene glycols (PEG's) with the general formula (XX), $$H—(OC_2H_4)_n—OH \quad (XX),$$

wherein n is a positive integer between 5 and >100,000.

Preferred polyethylene glycols have molecular masses of approx. 200-5,000,000 g/mol. The PEG's concern non-unity substances from a molecular point of view, i.e. polymolecular compounds which consist of collectives of macro-molecules with different molecular masses. These compounds are mostly prepared technically by means of alkaline catalyzed polyaddition of ethylene oxide (oxiran) in systems which mostly contain a low amount of water and with ethylene glycol as the starting molecule.

In order to characterize the types frequently the main point of the molecular weight division is used in the art. Thus talked is about a PEG 200, PEG 400, PEG 1000, PEG 10,000, etc.

PEG'S with molecular masses of <approx. 25,000 g/mol, i.e., n between approx. 5 and approx. 580 are preferred within the scope of the invention; these actual PEG's are liquid under normal conditions of pressure and temperature and therefore allow a very simple handling. Especially preferred are PEG's with n approximately between 8 and 13. Such compounds can be obtained for example under the trade name "Plural" from the company BASF.

Besides water and/or PEG's also the following aids and/or additives qualify as component (v):

solution intermediates, for example alcohols, polyalcohols, ether or polyether, especially isopropanol, butylglycyl, butyldiglycol or ethyleneglycolether;

Examples of components which qualify as solution intermediates can be found in the below table.

| chemical name | trivial or trade name |
|---|---|
| 1-propanol | n-propanol |
| 2,2,4-trimethyl-1,3-pentanediol monoisobutyrate | Texanol |
| 2-methyl-2,4-pentanediol | hexylene glycol |
| 2-propanol (99%) | isopropanol |
| diethyleneglycol butylether | butyl diglycol |
| diethyleneglycol ethylether | ethyl diglycol |
| dipropyleneglycol methylether | Dowanol DPM |
| ethanol denatured | ethanol denatured |

-continued

| chemical name | trivial or trade name |
|---|---|
| ethyleneglycol | ethyleneglycol |
| ethyleneglycol butylether | butyl glycol |
| propyleneglycol | propyleneglycol |
| propyleneglycol butylether | Dowanol PnB |
| propyleneglycol methylether | Dowanol PM |
| propyleneglycol propylether | Dowanol PnP |
| triethyleneglycol | Triethyleneglycol |
| ethanol | ethanol |

The amount of the solution intermediates to be used should be determined according to the individual amine to used, the professional will calculate the required solution intermediate in the individual case by means of trial and error. In general additions of solution intermediates in the range of 5 to 20 wt %, calculated on basis of the total composition, will be sufficient. Optionally, two or more of the solution intermediates may be employed as a mixture.

Further, as aid and/or additives according to the present invention particularly non-ionic and/or amphoteric surfactants merit consideration, for example fatty alcohols and alkoxylated fatty alcohols. These surfactants can improve the moistening of the chain and conveyor belts insofar as this is required in an individual case. In general surfactant additions in the range of 1 to 5 wt. %, calculated on basis of the total composition are sufficient for this purpose. Also, polyalkylene glycols which are not included in the above indicated polyethylene glycols can be employed. Additionally, one or more phosphate mono- or diesters as those indicated in U.S. Pat. No. 6,756,347 B1, WO 98/16603 or JP-B 6330079 also qualify as component (v).

Further additives include anti foaming agents, foam regulators, foam stabilizers, moistening agents, coupling agents, chelation agents or chelate formers or solubility improvers, biocides, like e.g. bactericides, corrosion inhibitors, pH-buffers, as well as combinations of representatives of the previously mentioned classes of substances.

Unless stated otherwise, each of the alkyl (or alkylene), alkenyl (or alkenylene) or alkynyl (or alkynylene) residues or fragments defined in formulas (I) to (XX), such as $R^1$ to $R^{21}$, $R^{1a}$ to $R^{1d}$ or $A^1$ to $A^{12}$ may independently be linear or branched, acyclic or cyclic. This also applies when they are part of other groups, for example in alkoxy groups ($C_1$-$C_{10}$-alkyl-O—), alkoxycarbonyl groups or amino groups, or when they are substituted.

Examples for alkyl groups are: methyl, ethyl, propyl, butyl, pentyl, hexyl, heptyl, octyl, nonyl, decyl. This comprises both the n-isomers of these residues and isopropyl, isobutyl, isopentyl, sec-butyl, tert-butyl, neopentyl, 3,3-dimethylbutyl etc. Furthermore, unless stated otherwise, the term alkyl here also includes—besides the unsubstituted alkyl residues—optionally substituted alkyl residues which are substituted by one or more, for example one, two, three or four, identical or different residues, for example aryl, heteroaryl $C_1$-$C_{10}$-alkoxy, —$CF_3$, —OH, —$NH_2$ or halogen. The substituents may be present in any desired position of the alkyl group. The term alkyl here also expressly includes cycloalkyl residues and cycloalkyl-alkyl-residues (alkyl substituted by cycloalkyl), where cycloalkyl contains at least three carbon atoms.

Examples for such cycloalkyl residues are cyclopropyl, cyclobutyl, cyclopentyl, cyclohexyl, cycloheptyl and cyclooctyl. All cycloalkyl groups may be unsubstituted or optionally substituted by one or more further residues, as exemplified above in the case of the alkyl groups. The same applies to the respective alkylene or cycloalkylene fragments.

Examples for alkenyl and alkynyl groups are the vinyl residue, the 1-propenyl residue, the 2-propenyl residue (allyl residue), the 2-butenyl residue, the 2-methyl-2-propenyl residue, the 3-methyl-2-butenyl residue, the ethynyl residue, the 2-propynyl residue (propargyl residue), the 2-butynyl residue or the 3-butynyl residue. Unless indicated otherwise the term alkenyl also includes cycloalkenyl residues and cycloalkenyl-alkyl-residues (alkyl substituted by cycloalkenyl) containing at least three carbon atoms. The same applies to the respective cycloalkynyl groups. Examples for cycloalkenyl residues are cyclopentenyl, cyclohexenyl, cycloheptenyl and cyclooctenyl. The same applies to the respective alkenylene, cycloalkenylene, alkynylene or cycloalkenylene fragments. Unless indicated otherwise, the terms alkenyl, alkynyl, etc. also include polyunsaturated residues such as alk-dienyl, alk-trienyl, alk-diynyl, etc.

According to the present invention, aryl is a residue derived from mono-, bicyclic or polycyclic aromatics having between 6 and 30, preferably 6 or 10, carbon atoms, where the cycle does not contain any heteroatoms. In case it is not a monocycle, the term aryl includes for its second cycle also its saturated form (perhydro form) or its partially unsaturated form (for example in the dihydro form or the tetrahydro form) in case the respective forms are known and stable. The term aryl as used herein comprises therefore, for example, bicyclic residues in which both cycles are aromatic as well as bicyclic residues in which only one cycle is aromatic. Such examples for heteroaryl are: phenyl, naphthyl, indanyl, 1,2-dihydronaphthenyl, 1,4-dihydronaphthenyl, indenyl or 1,2,3,4-tetrahydronaphthyl. Preferably, aryl is phenyl.

Furthermore, if residues or fragments defined in formulas (I) to (XX), such as $R^1$ to $R^{21}$, $R^{1a}$ to $R^{1d}$ or $A^1$ to $A^{12}$ comprise an aryl (or arylene) fragment, in particular phenyl, said aryl fragment may be unsubstituted or optionally substituted by one or more identical or different residues such as halogen $C_1$-$C_{10}$-alkyl, $C_1$-$C_{10}$-alkoxy, —OH, —$NH_2$ and —$CF_3$. Arylalkyl (such as aryl-($C_1$-$C_{10}$-alkyl)-, in particular phenyl-($C_1$-$C_{10}$-alkyl)-) means an alkyl residue (such as $C_1$-$C_{10}$-alkyl), which in turn is substituted by an aryl residue.

It has to be emphasized that the below indicated proportions of the individual components (i) to (iii) or (i) to (v), respectively, concerning the lubricant concentrate or the corresponding diluted (for example aqueous) use solutions, refer to the proportions of the respective components before the preparation of said concentrate or use solution, i.e. it is referred to the individual components as starting material (educts) before mixing them with each other. Due to the preparation of the lubricant concentrate (mixing of the individual components) it may happen that two or more of its components form partially or completely, for example, adducts such as salts. This may also depend on the presence of further components such as solvents, for example water. Such adducts of lubricant concentrates or diluted use solutions are also covered by scope of the present invention.

Although the favourable effects according to the invention can already be realized with arbitrary proportions of the components (i) to (iii), the lubricant concentrate according to the invention shows exceptionally favourable effects when the components (i): (ii) are present in a proportion of 1:0.5 to 1:2, always calculated on basis of the weight of all the components (i) as well as (ii).

Preferred is also a concentrate which is characterized that the components (i): (iii) are present in a proportion of 1:0.75 to 1:3, calculated on basis of the weight of all the components (i) as well as (iii).

As long as the proportion of amine to phosphate triester to the acid is within the mentioned range, excellent clear solubility will be obtained in an aqueous medium as well as an excellent gliding property will be achieved compared to compositions without the addition of phosphate triester.

The lubricant concentrate according to the invention contains the amine component (i) as a rule in an amount between 0.1 and 50 wt. %. The amine component (i) is present in an amount of 0.5 to 20 wt. % in a preferred version and 0.5 to 10 wt. % in a more preferred version of the lubricant concentrate according to the invention, whereby amounts of 2 to 6 wt. % are especially preferred.

The phosphate triester (component ii) is contained in the lubricant concentrate according to the invention generally in an amount of 0.1 to 50 wt. %. A value of 0.5 to 20 wt. % is preferred; 0.5 to 10 wt. % is more preferred; it has been shown that a value of 2 to 6 wt. % of phosphate triester in the lubricant concentrate according to the invention is especially preferred.

The component (iii) is generally present in the lubricant concentrate according to the invention in an amount between 0.1 and 50 wt. %. Amounts of 0.5 to 20 wt. % are preferred, 0.5 to 10 wt. % is more preferred, particularly preferred are values of 1 to 3.5 wt. %.

If present, the optional component (iv) is contained in the lubricant concentrate according to the invention generally in an amount of 0.1 to 50 wt. %. A value of 0.5 to 20 wt. % is preferred; 0.5 to 10 wt. % is more preferred; it has been shown that a value of 2 to 6 wt. % of phosphate triester in the lubricant concentrate according to the invention is especially preferred.

In a preferred implementation the concentrate according to the invention is characterized by 0.5 to 10 wt. % (i), 0.5 to 10 wt. % (ii), 0.5 to 10 wt. % (iii) and 70 to 98.5 wt. % (v), whereby all weight percentages are chosen such that a 100% (wt/wt) concentrate will be obtained. In other preferred implementations the concentrate additionally contains—besides components (i) to (iii) with same portions—0.5 to 10 wt. % (iv) and component (v) is 70 to 98 wt. % instead, whereby all weight percentages are chosen such that a 100% (wt/wt) concentrate will be obtained.

In a particularly efficient version the concentrate according to the invention shows the following contents:

(i) 2 to 6 wt. %,
(ii) 2 to 6 wt. %,
(iii) 1 to 3.5 wt. %,
(iv) 2 to 6 wt. % and
(v) 80 to 93 wt. %, whereby the amounts (i)-(v) are chosen such that the total results in 100 wt. %.

The lubricant concentrate is preferably unadjusted to a pH-value between 3 and 9, more preferred to a pH-value between 4 and 8.

Preferred lubricant concentrates contain the following components:

(i) is at least one amine of the general formula (VIII)

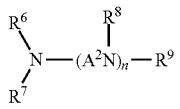

(VIII)

wherein $R^6$, $R^7$, $R^8$ and $R^9$ independently from each other are the same or different and indicate:

hydrogen, a substituted or unsubstituted, linear or branched alkyl rest with 1 to 22 C-atoms or a mono or polyunsaturated alkenyl rest with 2 to 22 C-atoms, which could display as substituents one or more hydroxyl, amine, imine, halogen and/or carboxyl rests or a substituted or unsubstituted phenyl rest, which could display as substituents one or more amine, imine, hydroxyl, halogen, carboxyl and/or possibly again substituted, linear or branched, saturated or mono or polyunsaturated alkyl rest with 1 to 22 C-atoms, $A^2$ indicates a linear or branched alkylene group with 1 to 8 carbon atoms, and n is a positive integer number in the range of 1 to 30, preferably 1 or 2, (ii) is at least one compound selected from components of formula (I), wherein $R^{1a}$, $R^{1b}$ and $R^{1c}$ independently from each other are the same or different and indicate $—([CH_2]_m—O)_nR^{1d}$, where m is 2, n is 1 to 3 and $R^{1d}$ is $C_1$-$C_{30}$-alkyl, (iii) is at least one saturated aliphatic monocarboxylic acids containing from one up to light carbon atoms.

In another preferred embodiment of the present invention, the lubricant concentrate contains as component (iii) additionally one or more unsaturated carboxylic acids, which contain between 7 and 20 carbon atoms. Preferably, oleic acid is employed as additional component (iii), more preferably in combination with at least one saturated $C_1$-$C_7$-carboxylic acid, in particular with acetic acid. In a further preferred embodiment, the lubricant concentrate contains besides the additional (one or more) unsaturated carboxylic acid(s), one or more polyethylene glycols according to the general formula (XX).

The presence of one or more unsaturated $C_7$-$C_{20}$-carboxylic acid has the advantage that a stable lubricant concentrate is obtained, which is also very effective as anti-foam agent. Said embodiment also has enhanced lubricity and significantly effects the depression of foam on feed and conveyance installations in the food industry.

In another preferred embodiment of the present invention the lubricant concentrate contains as component (iv) at least one compound selected from compounds of formula (II), wherein $R^{20}$ is a $C_3$-$C_{18}$-alkyl or alkenyl group, n is between 2 and 9 and M is hydrogen, sodium or potassium or, as component (v), it contains a) water and b) optionally at least one further acid or additive. In a further preferred embodiment, the lubricant concentrate contains both components (iv) and (v) having the above definitions (of the last sentence).

Furthermore, the invention relates to a process for the preparation of the lubricant according to the invention.

This is produced by mixing of the components (i), (ii) and (iii), possibly with addition of the components (iv) and (v). Water is preferred as component (v) thereby. Therefore, a further subject of the invention is a process for the preparation of a lubricant concentrate by means of mixing of the components (i) to (iii) and possibly addition of further components (iv) and/or (v).

Moreover, the invention relates to a lubricant solution for lubricating and cleaning of feed and conveyance installations in the food industry. The lubricant solution (which can be assigned as diluted use solution) is obtained by mixing a lubricant concentrate (containing components (i) to (iii) and optionally (iv) or (v) as indicated above) with a solvent. Thereby, the lubricant solution is characterized by a content of the following components in combinations:

a) a lubricant solution concentrate containing:
(i) at least one amine;
(ii) at least one phosphate according to the general formula I,

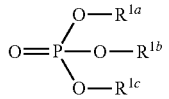

(I)

wherein
$R^{1a}$, $R^{1b}$ and $R^{1c}$ independently from each other are the same or different and indicate $C_1$-$C_{30}$-alkyl or —([$CH_2$]$_m$—O)$_n$—$R^{1d}$, where m is 2 or 3, n is 1 to 10 and $R^{1d}$ is $C_1$-$C_{30}$-alkyl, phenyl or phenyl-($C_1$-$C_{10}$-alkyl)-;
(iii) at least one acid;
(iv) optionally at least one ether carboxylic acid compound with the general formula II $$R^{20}—(O(CH_2)_m)_nOCH_2COO^-M^+ \quad (II)$$

wherein
$R^{20}$ is a saturated, linear or branched alkyl rest with 1 to 22 carbon atoms or a mono or polyunsaturated linear or branched alkenyl or alkynyl rest with 2 to 22 carbon atoms or an aryl rest optionally substituted with at least one $C_1$-$C_{22}$ alkyl, $C_2$-$C_{22}$ alkenyl or $C_2$-$C_{22}$-alkynyl,
n is a positive number between 0 and 30, and m is 2 or 3,
M is hydrogen or an alkali metal;
(v) optionally at least one further aid or additive;
whereby the portion of the components (i)+(ii)+(iii) with respect to the concentrate is 1 to 100 wt. %, and said optional components (iv) and (v) may be present in portions up to 99 wt. % (wt/wt), whereby the portions (i)-(v) are chosen such that the total results in 100 wt. %, and b) at least one solvent selected from water, polyethylene glycol, alcohol, ether and polyether;
whereby component a) is diluted with component b) by a dilution factor of 2 to 10,000.

According to the invention this lubricant solution (diluted use solution) can be obtained from the lubricant concentrate (component a)) according to the invention by means of dilution with a solvent (component b)) and a dilution factor of 2 to 10,000, preferably 100 to 2,000, more preferably with a factor 200 to 1,000; measured in volume % (vol. %).

Preferably, the lubricant solution (diluted use solution) is an aqueous use solution. The dilution is obtained by employing at least one of the solvents listed as component b). The same definitions and examples apply to the individual solvents (component b)) of the lubricant solution as already indicated above in the corresponding section of component (v) of the lubricant concentrate. Preferably, component b) is water, a mixture of water with at least one further solvent of component b) or an alcohol, which is preferably ethanol, isopropanol or n-propanol. More preferably, component b) is water, optionally in combination with at least one further solvent of component b). It has to be indicated that it is possible to employ a lubricant concentrate, which does not contain any water, but one or more other components listed under component (v) instead, and said concentrate is diluted with water to obtain an aqueous use solution.

The present invention further relates to the use of lubricant concentrates according to the art described before as chain lubricant in the food industry, particularly for the lubricating and cleaning of feed and conveyance installation in the food industry, particularly automatic chain and belt lubrication installations. The present invention particularly relates to the use of the lubricant concentrates described before in the form of a 0.01 to 50 wt. %. Additionally, the present invention relates to use of phosphate triesters according to general formula (I) for lubricating and/or cleaning of feed and conveyance installations in the food industry. Preferably, the phosphate triester is contained in a lubricant concentrate, more preferably in a lubricant solution, most preferably in an aqueous use solution.

This means that the present invention relates to the use of lubricant concentrates, preferably lubricant solutions, more preferably the aqueous use solution described before as a chain gliding and lubricating means suitable for lubricating and cleaning of feed and conveyance installations, in particular by means of immersion and/or automatic belt lubricating installations, in the food industry. The products according to the invention do not cause stress crack corrosion, in contrast to standard soap products, when applied with plastic objects, and therefore can be applied in particular without problems for PET or PC-objects. Accordingly, the lubricant solutions according to the invention can find use as chain lubricant for the feed or conveyance of objects or bottles made of glass, glass covered with a plastic layer, plastics, in particular polyethyleneterephthalate (PET), polycarbonate (PC) or polyvinylchloride, tin plate or aluminium, respectively varnished or plastic-layered containers made of these metals. The use thereby particularly relates to the filling up with foods, especially with beverages, of glass and plastic bottles, particularly in this case polyethylene terephthalate (PET), polyethylene naphthalate (PEN) or polycarbonate (PC), boxes, metal cans, glasses, vessels, refillable cans, barrels or vessels, such as KEGs, beverage containers, paper and cardboard holders and the like.

Therefore, the invention also relates to a process for the conveyance of beverage packings made of metal, glass, paper, cardboard and/or plastic, whereby a beverage conveyance device is contacted with a lubricating and cleaning amount of an aqueous use solution, as is defined herein.

The products according to the invention show, compared to known lubricants, a considerably better tolerance to water chemistry in an aqueous medium as well as considerably better gliding properties. Therewith, the desired technical properties of the lubricant concentrate, respectively the aqueous lubricant solution, can be adjusted purposefully by the choice of the triester and/or the amine, respectively the anion of the amine.

The following examples and comparative examples serve to present a more detailed explanation of the invention:

I Methods a.) Friction Coefficient

The experiments for the measurement of the friction coefficient were performed on a bottle conveyor under the following conditions:

6 glass bottles (0.5 litre) are placed on the test track.

Friction force [$F_Z$] is constantly measured via an electronic scales with A/D converter.

The coefficient friction force [$F_Z$]/weight of bottles [$F_N$] represents the friction coefficient [μ] which expresses the lubricity.

$$\mu = \frac{F_Z}{F_N}$$

Spraying of the conveyor with a 0.3 wt. % lubricant solution.

Speed of the conveyor: approx. 0.4 m/s.

Phase time: 40 sec. spraying/60 sec. non spraying

Spraying performance per spray nozzle: approx. 4 litre/h

Furthermore, the products were tested with hard water (16° dH) according to the provisions of DIN 53 902 and tested in completely desalinated water.

The variance is a measure for the uniformity of lubricity or friction, respectively on the conveyor belt installations (tracks or chains), being determined from the noise of the friction coefficient measurements. A decreasing variance value relates to a more uniform lubrication on the tracks or chains. The time when the noise of the friction of the coefficient measurement is at a constant level indicates the starting point for transporting the beverage packings on the conveyor due the formation of uniform lubricating film.

b.) Water Compatibility

The compositions to be applied according to the invention show an excellent water compatibility, which can be shown by the performed turbidity measurements (Nephelometer).

Herewith, the regular removal of waste, which develops because of the reaction of ions, like sulphate, phosphate and carbonate, with the lubricant solution, can be prevented.

For this propose 0.3 wt. % use solutions were measured over a period of 7 days (168 hours). These experiments were performed in the following water conditions:

| Content | Concentration [mg/L] |
|---|---|
| Sodium sulphate ($Na_2SO_4$) | 148 |
| Sodium chloride (NaCl) | 165 |
| Sodium hydrogen carbonate (Na $HCO_3$) | 138 |
| Calcium chloride (CaCl × 2 $H_2O$) | 275 |

The water compatibility is expressed in FNU (Formazine nephelometric units).

0 to 1 FNU=clear
1 to 10 FNU=weak, opalescent
10 to 50 FNU=turbidity
50 to >100 FNU=strongly turbidity c.) Foam Behaviour The foam behaviour was calculated according to the following method:

100 ml of the use solution (0.3%) was transferred into a 250 ml measuring cylinder. Thereafter it was shaken 30 times during 30 seconds and after a further 20 seconds the volume of the foam above the 100 ml mark was read off.

d.) Material Compatibility PET

The material compatibility of the mixture according to the invention as well as a comparative example was examined in a test.

For this, the following equipment was needed:

Environmental camber:

in each case 20 new PET bottles (1.5 L) in crates, $CO_2$-cylinder with fitting reducing valve, attachment for filling of the bottles with $CO_2$, separate manometer for testing the bottles with regard to $CO_2$;

The tests were executed in the following manner:

At first, the bottles were filed with 1.5 L VE-water, thereafter 3.0-3.1 bar $CO_2$ was led into the bottles via an attachment. Then the quantity of $CO_2$ was dissolved into the water by means of shaking. All $CO_2$ was considered to be dissolved only after the test manometer indicated 0 bar.

1.) The bottles were now dipped shortly into concentrated belt lubricant (BSM) (~2 cm) and thereafter allowed to stand for 24 hours.

2.) Thereafter the bottles were filled in crates and allowed to stand in a climatic cabinet at 38° C. and 85% relative humidity for 6 days.

As reference a bottle was taken along in each crate which was not dipped into BDM. At the end of the test a visual estimation was made. Here, 5 categories are distinguished.

O: No damages
A: Minor damages
B: Moderate, superficial cracks
C: Multiple, moderately deep cracks
D: Multiple, deep cracks II Results

| | Example no. | | | | | | |
|---|---|---|---|---|---|---|---|
| Components [wt. %] | C1 | 1 | 2 | 3 | 4 | 5 | 6 |
| Water (softened) | 65.5 | 95.00 | 92.50 | 90.00 | 87.50 | 86.50 | 82.00 |
| Didecyl dimethyl ammonium chloride | 5.00 | | | | | | |
| N-oleyl-1,3-diamino-propane | | 5.00 | 5.00 | 5.00 | 5.00 | 5.00 | 5.00 |
| tributoxy ethylphosphate | | | | 5.00 | 5.00 | 5.00 | 5.00 |
| mixture of phosphate mono- and diester having C10-alkyl and 4 EO units | 15.00 | | | | | | |
| acetic acid (60%) | | | 2.50 | | 2.50 | 2.50 | 4.00 |
| NaOH | 2.00 | | | | | | |
| alkyl (C16-18) ether (9EO) carboxylic acid (90%) | | | | | | 1.00 | 4.00 |
| EDTA, 40% | 10.00 | | | | | | |
| C12-C15 linear alcohol with 7 EO units | 2.50 | | | | | | |
| Total | | 100.0 | 100.0 | 100.0 | 100.0 | 100.0 | 100.0 |
| Remarks | turbid | phase separation | clear | phase separation | clear | clear | clear |
| friction coefficient μ | 0.158 | not applicable | 0.159 | not applicable | 0.143 | 0.136 | 0.131 |
| variance | 0.000051099 | not applicable | 0.0000895 | not applicable | 0.00003484 | 0.00001307 | 0.00001096 |

From the above table it can be seen that each of the lubricant concentrates according to the present invention shows at least comparable, most embodiments an enhanced lubricity compared with lubricant concentrates according to the state of the art. Additionally, they are stable as clear solutions and provide more uniforms lubrication on tracks and chains of feed and conveyance installation in food industry due to the improved variance.

The invention claimed is:

1. A lubricant concentrate containing the following components:

(i) at least one amine;

(ii) at least one phosphate according to the general formula I,

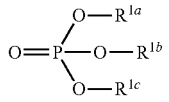

(I)

wherein $R^{1a}$, $R^{1b}$ and $R^{1c}$ independently from each other are the same or different and indicate $—([CH_2]_m—O)_n—R^{1d}$, where m is 2 or 3, n is 1 to 10 and $R^{1d}$ is $C_1$-$C_{30}$-alkyl;

(iii) at least one acid;

(iv) optionally at least one ether carboxylic acid compound with the general formula II $$R^{20}—(O(CH_2)_m)_nOCH_2COO^-M^+ \quad (II)$$

wherein $R^{20}$ is a saturated, linear or branched alkyl rest with 1 to 22 carbon atoms or a mono or polyunsaturated linear or branched alkenyl or alkynyl rest with 2 to 22 carbon atoms or an aryl rest optimally substituted with at least one $C_1$-$C_{22}$ alkyl, $C_2$-$C_{22}$ alkenyl or $C_2$-$C_{22}$-alkynyl, n is a positive number between 0 and 30, and m is 2 or 3, M is hydrogen or an alkali metal;

(v) optionally at least one further aid or additive;

whereby the portion of the components (i)+(ii)+(iii) with respect to the concentrate is 1 to 100 wt. %, and said optional components (iv) and (v) may be present in portions up to 99 wt. %, whereby the portions (i)-(v) are chosen such that the total results in 100 wt. %.

2. The concentrate according to claim 1, wherein the concentrate contains the components (i):(ii) in a proportion of 1:0.5 to 1:2, always calculated on basis of the weight of all components (i) as well as (ii) and/or that it contains the components (i):(iii) in a proportion of 1:0.75 to 1:3, always calculated on basis of the weight of all components (i) as well as (iii).

3. The concentrate according to claim 1, wherein (i) is at least one amine of the general formula (VIII)

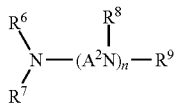

(VIII)

wherein $R^6$, $R^7$, $R^8$ and $R^9$ independently from each other are the same or different and indicate:

hydrogen, a substituted or unsubstituted, linear or branched alkyl rest with 1 to 22 C-atoms or a mono or polyunsaturated alkenyl rest with 2 to 22 C-atoms, which could display as substituents one or more hydroxyl, amine, imine, halogen and/or carboxyl rests or a substituted or unsubstituted phenyl rest, which could display as substituents one or more amine, imine, hydroxyl, halogen, carboxyl and/or possibly again substituted, linear or branched, saturated or mono or polyunsaturated alkyl rest with 1 to 22 C-atoms, $A^2$ indicates a linear or branched alkylene group with 1 to 8 carbon atoms, and n is a positive integer number in the range of 1 to 30, (ii) is at least one compound selected from components of formula (I), wherein $R^{1a}$, $R^{1b}$ and $R^{1c}$ independently from each other are the same or different and indicate $—([CH_2]_m—O)_n—R^{1d}$, where m is 2, n is 1 to 3 and $R^{1d}$ is $C_1$-$C_{30}$-alkyl, (iii) is at least one saturated aliphatic monocarboxylic acids containing from one up to eight carbon atoms.

4. The concentrate according to claim 1, wherein (i) is N-tallow-1,3-diaminopropane, N-coco-1,3-diaminopropane and/or N-oleyl-1,3-diaminopropane;

(ii) is at least one compound selected from compounds of formula (I), wherein $R^{1a}$, $R^{1b}$ and $R^{1c}$ have the same meaning and indicate $—([CH_2]_m—O)_n—R^{1d}$, where m is 2, n is 1 to 3 and $R^{1d}$ is $C_1$-$C_{30}$-alkyl (iii) is acetic acid.

5. The concentrate according to claim 1, wherein in component (ii) $R^{1a}$, $R^{1b}$, and $R^{1c}$ have the same meaning and indicate $—CH_2—CH_2—O—CH_2—CH_2—CH_2—CH_3$ or $—CH_2—CH_2—O—CH(CH_3)—CH_2—CH_3$.

6. The concentrate according to claim 1, wherein component (iii) is one or more of hydrochloric acid, hydrobromic acid, phosphoric acid, metaphosphoric acid, nitric acid, sulfonic acid and sulfuric acid, formic acid, acetic acid, propionic acid, butyric acid, stearic acid, oxalic acid, malonic acid, succinic acid, glutaric acid, benzoic acid, citric acid, maleic acid, fumaric acid, methanesulfonic acid, acrylic acid, propiolic acid, methacrylic acid, crotonic acid, isocrotonic acid, oleic acid, elaidic acid or trifluoroacetic acid.

7. The concentrate according to claim 1, containing as component (iii) additionally one or more unsaturated carboxylic acids containing between 7 and 20 carbon atoms.

8. The concentrate according claim 1, wherein component (iv) is present and is at least one compound selected from the compounds of formula (II), wherein $R^{20}$ is an oleyl group and n is 9.

9. The concentrate according to claim 1, wherein components (iv) and (v) are present and (iv) is at least one compound selected from compounds of formula (II), wherein $R^{20}$ is a $C_3$-$C_{18}$-alkyl or alkenyl group, n is between 2 and 9 and M is hydrogen, sodium or potassium, (v) is a) water and b) optionally at least one further aid or additive.

10. The concentrate according to claim 1, wherein component (v) is present and is at least one compound selected from the compounds of formula (XX)

$$H—(OC_2H_4)_n—OH \quad (XX)$$

wherein n is a positive integer between 5 and 100,000.

11. The concentrate according to claim 10, wherein n is a positive integer between 5 and 580.

12. The concentrate according to claim 10, wherein n is a positive integer between 8 and 13.

13. The concentrate according to claim 1, wherein component (v) is present and is at least one of 1-propanol, 2,2,4-trimethyl-1,3-pentanediol monoisobutyrate, 2-methyl-2,4-pentanediol, 2-propanol, diethyleneglycol butyl ether, diethyleneglycol ethyl ether, dipropylene glycol methyl ether, ethanol, denatured ethanol, ethyleneglycol, ethyleneglycol butyl ether, propyleneglycol butyl ether, propyleneglycol methyl ether, propyleneglycol propyl ether, or triethyleneglycol.

14. The concentrate according to claim 1, characterized by the following composition:

(i) 2 to 6 wt. %, (ii) 2 to 6 wt. %, (iii) 1 to 3.5 wt. %, (iv) 2 to 6 wt. %, and (v) 80 to 93 wt. %, whereby the quantities of (i)-(iv) are chosen such that the total sum of it is 100 wt. %.

15. A process for the preparation of a lubricant concentrate according to claim 1 by means of mixing of the components (i) to (iii) and possibly addition of further components (iv) and/or (v).

16. A lubricant solution containing as components a) a lubricant concentrate according to claim 1 and b) at least one solvent selected from water, polyethylene glycol, alcohol, ether and polyether; whereby component a) is diluted with component b) by a dilution factor of 2 to 10000.

17. The lubricant solution according to claim 16, wherein component b) is water.

18. A process for the conveyance of beverage packings made of metal, glass, paper, cardboard and/or plastic, comprising contacting a beverage conveyance installation with a lubricating and cleaning amount of a lubricant solution according to claim 16.

19. The process according to claim 18, wherein the contacting step is by immersion or automatic belt lubricating installations.

20. The process according to claim 18, wherein the beverage packings are selected from the group consisting of glass bottles, plastic bottles, plastic covered glass bottles, boxes, metal cans, glasses, vessels, refillable cans, barrels, beverage containers and paper and cardboard holders.

21. The process according to claim 20, wherein the plastic bottles are selected from polyethylene terephthalate (PET), polyethylene naphthalate (PEN), polyvinylchloride, or polycarbonate.

* * * * *